United States Patent [19]

Killop

[11] 3,982,415

[45] Sept. 28, 1976

[54] FORMING METHOD AND MACHINE FOR SPLINING POWER TRANSMISSION MEMBERS

[75] Inventor: James Thomas Killop, Warren, Mich.

[73] Assignee: Anderson-Cook, Inc., Fraser, Mich.

[22] Filed: Aug. 21, 1975

[21] Appl. No.: 606,398

Related U.S. Application Data

[63] Continuation-in-part of Ser. No. 537,887, Jan. 2, 1975, abandoned.

[52] U.S. Cl. ..... 72/88; 72/469; 74/431

[51] Int. Cl.[2] ..... B21D 9/14; B21D 53/28

[58] Field of Search ..... 72/88, 90, 105, 469, 72/370, 193, 96

[56] References Cited

UNITED STATES PATENTS

| | | | |
|---|---|---|---|
| 3,214,951 | 11/1965 | McCardell | 72/88 |
| 3,407,638 | 10/1968 | Greis et al. | 72/96 |
| 3,630,058 | 12/1971 | Kiplinger | 72/96 |
| 3,672,203 | 6/1972 | Anderson | 72/469 |

*Primary Examiner*—Milton S. Mehr
*Attorney, Agent, or Firm*—Reising, Ethington, Barnard, Perry and Brooks

[57] ABSTRACT

A method and machine for splining a power transmission member by rolling are disclosed as well as the resultant splined member. An externally toothed pinion-type mandrel of the machine is rotatably mounted between a pair of elongated dies. An unsplined member is supported by the mandrel so that sliding movement of the elongated dies from an end-to-end relationship to an overlapping relationship meshes teeth on the dies and the teeth on the mandrel with a thin-walled annular sleeve portion of the member therebetween. The meshing of the die and mandrel teeth deforms the sleeve portion of the member radially to form the splines and also rotates the mandrel to complete the spline forming operation about the total circumference of the member. The mandrel may be removably mounted in a manner that permits a pair of the members to be simultaneously splined by a single stroke of the elongated dies. The mandrel and one of the dies include synchronizing teeth that are directly meshed with each other to synchronize the commencement of mandrel rotation with the commencement of die movement. The die teeth are sized to form the splines radially in a unique progressive manner and have tooth forms that prevent slippage between the dies and the sleeve portion being splined. Also, the teeth may form the lengths of the splines progressively to lessen the maximum tooth load and thereby increase the die life. The splined member has relatively tough splines and an end mounting wall that is maintained flat during the spline rolling.

50 Claims, 23 Drawing Figures

26'
26''
26'''
34'
34''
34'''
34's'
34's''
34's'''
42
44
46
48
a
b
c
d
e
f
i

FORMING METHOD AND MACHINE FOR SPLINING POWER TRANSMISSION MEMBERS

This application is a continuation-in-part of application Ser. No. 537,887, filed on Jan. 2, 1975, now abandoned, the entire disclosure of which is incorporated herein by reference.

BACKGROUND OF THE INVENTION

1. Field of the Invention

The present application relates to a method and machine for forming splines on a power transmission member, such as a clutch hub for a vehicle automatic transmission, and to the splined member that is formed thereby.

2. Description of the Prior Art

Power transmission members to which this invention relates are utilized to couple rotary drive and driven members. These types of members may be utilized in many different environments, such as speed reducing gear units, other transmissions with multi-speed outputs such as vehicle transmissions, etc. These power transmission members may take many forms. One type includes splines that receive complementary splines on another member to provide a rotary driving relationship therebetween. This type of splined member may be embodied as a solid splined shaft or a member having an annular sleeve portion of a thin-walled construction where the splines are formed. This latter type of splined member is the type to which the present invention is directed.

Vehicle automatic transmissions incorporate the type of power transmission member to which this invention relates. These transmissions include a number of drive trains through which rotary power is transmitted from the vehicle engine to its driving wheels. The drive trains of the transmission each include one or more clutches in engaged or disengaged conditions to couple or disconnect the engine from the driving wheels through that particular drive train. Within each clutch, two rotary clutch components are either coupled for rotary movement with each other or uncoupled so that one rotates without the other in order to establish the engaged or disengaged condition of the clutch.

The coupling and uncoupling of clutch components within a vehicle automatic transmission clutch is accomplished by the use of clutch discs and a power transmission member embodied as a clutch hub. The clutch hub is mounted on one of the rotary clutch components and has a thin-walled annular sleeve portion that receives a number of annular clutch discs in a stacked relationship. The clutch discs may either be mounted about the exterior of the sleeve portion or within the interior thereof and have either their outer or inner peripheral edges formed with splines that are received by complementary splined configurations on the sleeve portions so as to be rotatably fixed with respect to the clutch hub and the clutch component on which the hub is mounted. The other clutch component also has a number of thin clutch discs rotatably fixed to it and received in an alternating manner between the clutch discs associated with the clutch component carrying the hub. The clutch discs are axially slidable with respect to the clutch hub so that a fluid motor of the clutch can frictionally engage the stacked clutch disc arrangement upon being supplied with a fluid pressure to thereby interconnect the two clutch components for rotation with each other. Upon termination of the supply of fluid pressure to the motor of the clutch, the clutch discs can frictionally slide at their engaged surfaces to allow relative rotation between the two clutch components. The sleeve portion of the hub usually has lubrication ports through which a lubricant for the clutch flows.

The type of automatic transmission clutch hub described above generally has a somewhat cup-shaped configuration with an annular end wall used to mount the hub as well as the annular sleeve portion having the thin-walled construction where the clutch hub splines are formed. The end wall extends radially in an inward direction from one end of the sleeve portion which extends axially. Conventionally, the splines have been formed by first placing an unsplined hub blank on a mandrel and then performing an impact operation using suitable dies. Usually, this impact operation has been performed using two dies oriented in a 180° opposed relationship so that the splines are formed by forceful movement of each die toward the other with the mandrel and the clutch hub blank between the dies. The dies thus impact the clutch hub in an aligned relationship with respect to each other to balance the impact forces on the mandrel. A number of strokes are performed to form each spline, proceeding from the end wall toward the open end of the hub. After each spline is formed, the mandrel is rotated slightly to permit the splines to be formed adjacent the previously formed ones. A one-half revolution of the mandrel and clutch hub blank thus completes the splining to form a splined clutch hub for a vehicle automatic transmission.

The spline forming described above causes a work hardening of the metallic material, i.e. steel, from which the hubs are made. This work hardening makes the sleeve portion less tough and more brittle. Also, the sleeve portion is deformed axially along the splines. The axial deformation distorts the flatness of the radial end wall of the hub used to mount it. Lubrication ports formed in the sleeve portion of the hub cannot be made prior to the spline forming because the axial deformation of the sleeve portion would distort the configuration of the ports.

Prior art patents which are somewhat similar to the teachings of the present invention are described below; but important differences therebetween will be readily apparent to those skilled in the art.

U.S. Pat. No. 3,214,951 discloses apparatus for rolling teeth on tubular elements which utilizes elongated dies that cooperate with a smooth cylindrical mandrel received within a tubular element to be splined. Longitudinal sliding movement of the dies in a parallel fashion with respect to each other on opposite sides of the mandrel forms teeth on the tubular element by forcing cold flow of the material of the tubular element. The interior surface of the tubular element remains undeformed and smooth due to the support provided by the smooth outer surface of the mandrel on which the tubular element is mounted.

U.S. Pat. No. 3,407,638 discloses a method for forming serrated or corrugated hollow tubes wherein a toothed mandrel is positioned within a hollow tube and then positioned between two rotating dies. Engagement of the rotating dies with the hollow tube mounted on the mandrel then causes tube deformation to serrate or corrugate the tube. The rotational position of the rotating dies must be maintained accurately along a single diameter of the axis of mandrel rotation or, otherwise, the force load applied to the mandrel will be unbalanced. A similar corrugating operation is performed by a machine disclosed by U.S. Pat. No. 3,630,058.

SUMMARY OF THE INVENTION

The present invention is directed to a machine and method for splining power transmission members, such as vehicle automatic transmission clutch hubs and the like, and to the splined members produced thereby. The machine includes a toothed mandrel and a pair of elongated dies slidably supported for movement in a parallel fashion with respect to each other between an end-to-end relationship and an overlapping relationship. Teeth are spaced along the length of each die, and the mandrel has a central axis from which its teeth extend radially in an outward direction. An unsplined power transmission member is mounted on the mandrel with a thin-walled annular sleeve portion of the member positioned over the mandrel teeth. The mandrel is supported for rotation about its central axis so that movement of the dies from their end-to-end relationship to their overlapping relationship meshes the die teeth and mandrel teeth with the sleeve portion of the member therebetween. The meshing forms splines in the sleeve portion by a rolling process and thereby provides a splined power transmission member.

The mandrel may be supported on the spline forming machine so as to be removable therefrom to permit removal of a splined member after the splining operation and to permit the mandrel to receive another member to be splined. Mounting the mandrel for removal from the machine also permits a pair of unsplined members to be mounted on opposite ends of the mandrel in an opposed relationship so that splines may simultaneously be formed on both members during a single stroke of the pair of elongated dies into their overlapping relationship. The mandrel is supported in the removable fashion by a fixed headstock and a movable tailstock arrangement incorporating a pair of arbors respectively mounted by the headstock and tailstock. The arbors of the headstock and tailstock are provided with aligned shafts that are received by an axial opening of the mandrel to provide the support about which the mandrel rotates.

The die teeth are arranged in groups along the length of the dies projecting from a common root line. The teeth of each group project from the root line with the same height, but the teeth have an increasing height from one group to the next while moving in a direction opposite to the direction of die movement. Each group of teeth has a length equal to at least one-half the circumference of the sleeve portion of the member being splined so that the increasing size of die teeth causes the splining to proceed in a progressive manner as each successive group of teeth deforms the sleeve portion. The first group of teeth at the leading end of each die has a tooth form whose tip defines a flat surface with straight line chamfers at both its leading and trailing sides to facilitate gripping of the sleeve portion of the hub blank being splined. The first group of teeth performs at least 75%, and preferably over 90%, of the radial deformation as these chamfered teeth mesh with the rotating mandrel teeth during the die movement into the overlapping die relationship. The second group of teeth on each die to engage the sleeve portion has a tooth form whose tip is rounded so as to begin the forming of the final tooth-shaped configuration being splined. The third group of teeth on each die to engage the sleeve portion also has a tooth form whose tip is rounded but with a configuration more like the largest group of teeth than the second group so the deformation proceeds in a progressive manner toward the final spline form. Each succeeding group of teeth to engage the annular sleeve portion being splined has a tooth form that is congruent from its tip to the root line with the portion of the tooth form of the largest group of teeth from its tip toward the root line for a corresponding distance. The final groups of teeth deform the annular sleeve portion radially only a slight amount in a manner that provides close tolerance roundness to the final configuration of the splined member.

One of the elongated dies has a plurality of synchronizing teeth preceding the first group of teeth that deform the power transmission members as they are splined. The synchronizing teeth of the die are directly meshed with synchronizing teeth of the mandrel so that the mandrel commences rotating as the dies begin to move from their end-to-end relationship toward their overlapping relationship. Preferably, the synchronizing teeth of the die are located intermediate lateral sides of the die so that a pair of the members may be simultaneously splined by the lateral sides of the dies on opposite lateral sides of the synchronizing teeth. The synchronizing teeth of the mandrel are preferably defined by a synchronizing member that has the generally annular but splined configuration of one of the members after splining. This synchronizing member is slid over one end of the removable mandrel and secured intermediate its opposite ends so as to permit the mandrel to mount one power transmission member to be splined on each of its ends.

In one embodiment, the teeth of each group have sufficient lengths to perform the splining deformation for the whole lengths of the splines. In alternate embodiments, the groups of smaller teeth have shorter lengths and form only a portion of the lengths of each spline. The groups of larger teeth have longer lengths so that the splines are formed progressively lenghtwise as well as radially. The progressive lengthwise splining lowers the tooth load on the smaller teeth and thereby lengthens the die life. Preferably, the teeth of the smaller groups are progressively longer lengthwise from the leading end of the group toward the trailing end so that the progressive lengthwise splining takes place within the group as well as from one group to the next.

In one of the alternate die embodiments performing the progressive lengthwise splining, the die teeth are arranged to begin at a central portion of each spline and to proceed progressively toward the opposite ends of the spline. In two other of the alternate die embodiments, the splining begins at one end of each spline and proceeds progressively toward its other end. When used to spline clutch hubs, one of these last two alternate embodiments forms the splines progressively lengthwise from its open end toward its end wall and the other begins at the end wall and forms the splines progressively toward the open end of the hub.

The mandrel of the machine may be of a radially expandable type to facilitate mounting of power transmission members thereon for splining and removal of these members therefrom after splining.

The splined power transmission members produced by the rolling fashion of this invention are relatively tough due to a lack of excessive work hardening. There is no axial deformation of the sleeve portion being splined and the axial length of the member thus is constant before and after splining. Consequently, the sleeve portion can be formed with lubrication ports prior to the splining without being deformed axially in a manner that would distort the ports. Also, the lack of axial deformation causes the end wall of a member being splined to maintain its flatness. This facilitates the mounting of the splined member for use. In one version, the splines of a power transmission member terminate short of an end wall thereof so the sleeve portion of the member defines an unsplined ring that helps to maintain the end wall flatness.

The features, objects and advantages of the present invention will become apparent from the following detailed description of the preferred embodiments taken in conjunction with the accompanying drawings.

DETAILED DESCRIPTION OF THE PREFERRED EMBODIMENTS

Figure 1:
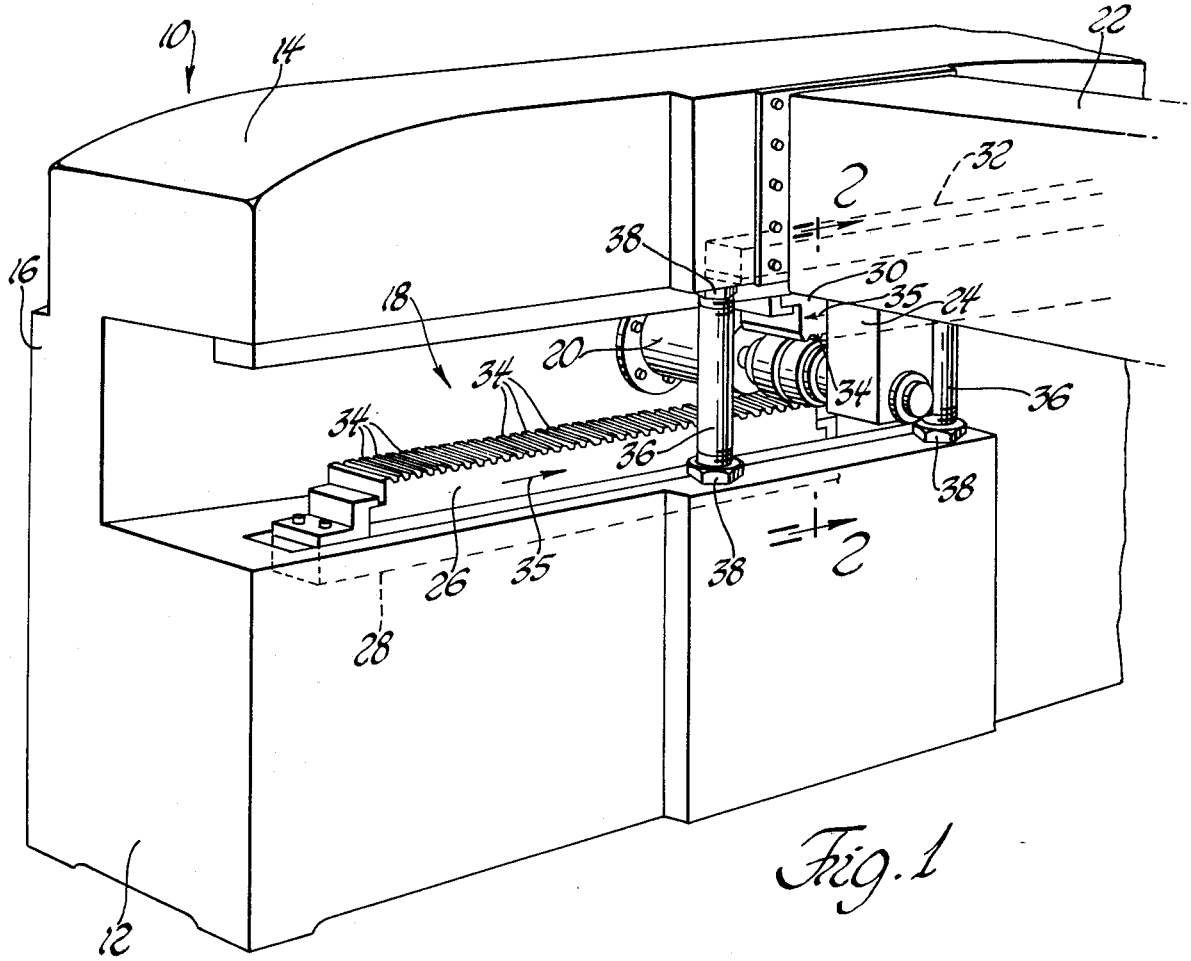
FIG. 1 is a perspective view of a spline forming machine that embodies and is used to roll splines in accordance with the present invention.

In FIG. 1, reference numeral 10 collectively indicates a spline forming machine having a lower floor supported base 12, an upper base 14, and a support portion 16. The support portion 16 extends upwardly from lower base 12 and the upper base 14 extends forwardly from the support portion 16 to cooperate with the lower base in defining an upwardly and downwardly confined work space generally indicated by reference numeral 18. Within the work space 18, a fixed headstock 20 is mounted on the support portion 16 between the lower and upper bases 12 and 14. A tailstock support arm 22 projects from the upper base 14 and includes a suitable slide arrangement for supporting a tailstock 24. The tailstock 24 depends downwardly from the support arm 22 and is slidably movable toward and away from the headstock 20 along a rectilinear path.

Within the work space 18 of the machine, a lower elongated die 26 is slidably supported on the lower base 12 by a slide support shown by hidden lines and indicated by reference numeral 28. An elongated upper die 30 is supported on the upper base 14 by a slide support 32 also indicated by hidden lines. The slide supports 28 and 32 mount the dies 26 and 30 in a spaced and parallel relationship with respect to each other for sliding movement between the end-to-end relationship shown in FIG. 1 and an overlapping relationship. Each of the dies 26 and 30 is elongated rectilinearly and has teeth 34 spaced along its length. The die teeth 34 extend transversely with respect to the direction of die movement and are oriented in a spaced and parallel fashion opposing the die teeth of the other die when the dies assume their overlapping relationship after movement in the direction of the arrows 35 as shown in FIG. 1. The dies are actuated by a suitable power operated actuator that coordinates the movement of each die with that of the other to perform a splining operation which will be hereinafter described. A pair of rods 36 extend between the lower and upper bases 12 and 14 and are threaded into respective nuts 38 on the bases to control the deflection permitted between the dies as the splining operation proceeds. Rotation of the rod increases or decreases tension along the rod length depending on the direction of rotation to either allow greater or lesser die deflection as required.

Figure 2:
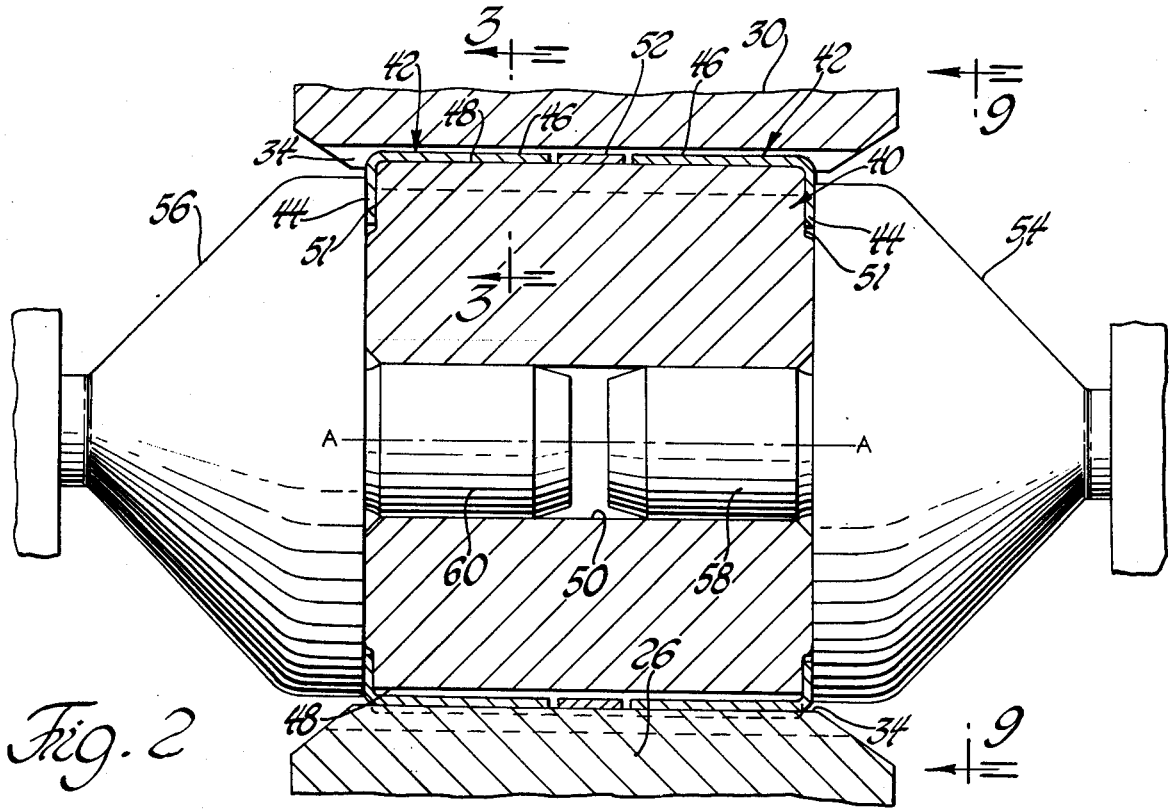
FIG. 2 is an enlarged sectional view taken along line 2—2 of FIG. 1.

With reference to FIG. 2, an externally toothed pinion type mandrel indicated generally by reference numeral 40 is located between the lower and upper dies 26 and 30 to support a pair of power transmission members on which splines are to be formed, such as the vehicle automatic transmission clutch hub blanks 42 shown. It should be understood that other power transmission members used to transmit rotary power can likewise be splined by the machine and that it is not limited to clutch hubs even though the splining operation will be described in relation to this particular type of power transmission member.

Figure 4:
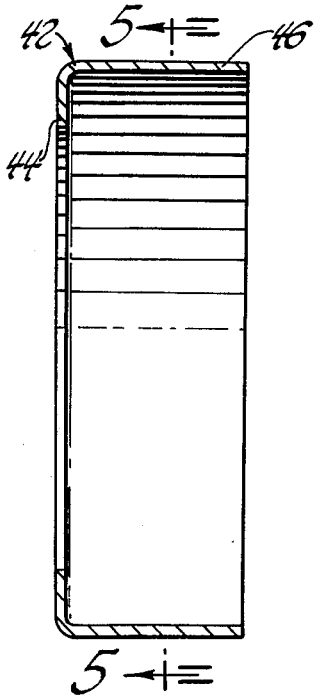
FIG. 4 is a sectional view of a power transmission member taking the form of a clutch hub blank like those shown in FIG. 2.
Figure 5:
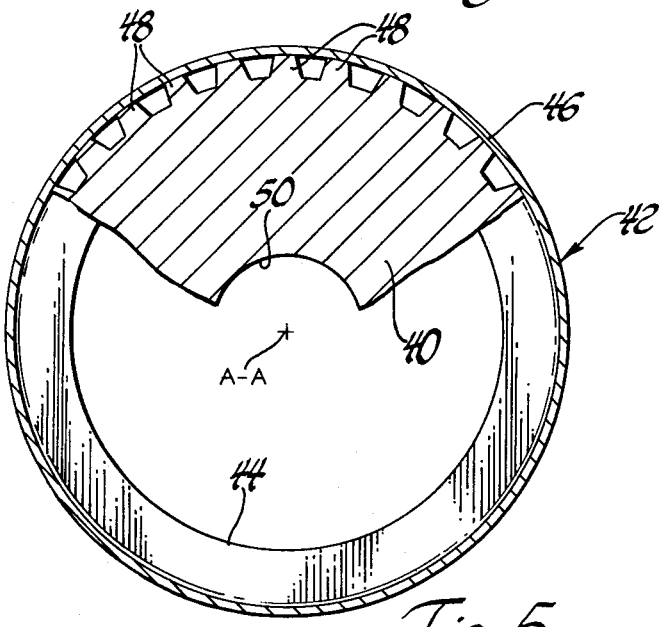
FIG. 5 is a sectional view taken along line 5—5 of FIG. 4, and also illustrates a fragmentary portion of the mandrel of FIG. 2 within the hub blank.

FIGS. 4 and 5 illustrate the configuration of the clutch hub blanks 42 prior to being subjected to the splining operation of machine 10. Each clutch hub blank 42 has a somewhat cup-shaped configuration with an open end and a partially closed end. The hub blanks each include an annular end wall 44 and a side wall taking the form of a thin-walled annular sleeve portion 46. The end wall 44 and the sleeve portion 46 are both generated about the central axis of the hub blank. The end wall 44 extends radially with respect to this axis and is flat to permit mounting of the clutch hub after its splining operation on a clutch member of a vehicle automatic transmission. At the outer peripheral edge of the end wall 44, the annular sleeve portion 46 extends axially with respect to the central axis of the hub blank 42. The thin-walled construction of the annular sleeve portion 46 permits it to be deformed to form splines extending parallel to the central axis of the hub blank.

Figure 7:
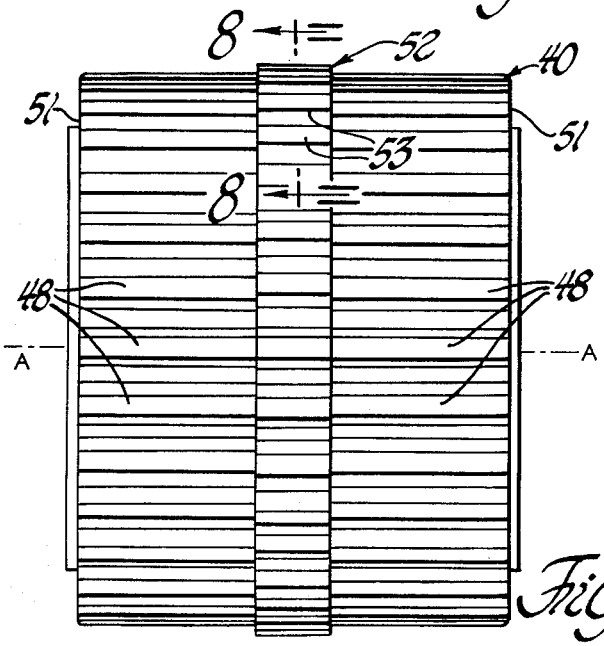
FIG. 7 is a side view of the mandrel of FIG. 2.
Figure 8:
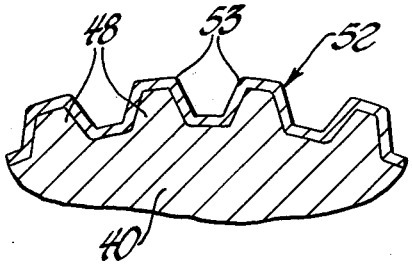
FIG. 8 is a fragmentary sectional view taken along line 8—8 of FIG. 7.

With particular reference to FIGS. 2, 5 and 7, the mandrel 40 has a central axis A—A about which teeth 48 thereof are generated. The mandrel teeth 48 project radially in an outward direction from the central mandrel axis A—A and are spaced about the axis so as to engage the annular sleeve portions 46 of the two clutch hub blanks 42 that are mounted on the mandrel, FIG. 2. The teeth 48 are elongated in a direction parallel to the central mandrel axis A—A and extend between the end walls 44 of the two clutch hub blanks 42. A central axial opening 50 extends between opposite ends 51 of the mandrel. Also, a synchronizing member 52 is located intermediate the opposite ends 51 of the mandrel between the hub blanks 42 and includes synchronizing teeth 53, FIG. 8, whose function will be hereinafter described.

With reference to FIG. 2, a pair of right and left-hand arbors 54 and 56 are respectively associated with the opposite ends 51 of the mandrel to provide rotatable support thereof about the central mandrel axis A—A. The right-hand arbor 54 is mounted in a suitable manner on the tailstock 24 shown in FIG. 1 and includes a shaft 58 projecting toward the headstock 20. The left-hand arbor 56 is mounted on the headstock 20 and includes a shaft 60 that projects toward the tailstock 24 in alignment with the shaft 58 of the tailstock arbor 54. The mandrel 40 is freely removable from the machine 10 so as to accept the pair of clutch hub blanks 42 supported in opposed relationship on the opposite ends 51 of the mandrel. The mandrel 40 is then mounted on the tailstock 24 by moving the mandrel so one end of its axial opening 50 receives the shaft 58 of the tailstock arbor 54. The tailstock 24 is then moved toward the headstock 20 so that the other end of the mandrel opening 50 receives the shaft 60 on the headstock arbor 56. The fixed headstock and movable tailstock then provide a mounting means for supporting the mandrel in a rotatable fashion about axis A—A which is located midway between the lower and upper dies 26 and 30.

Figure 3:
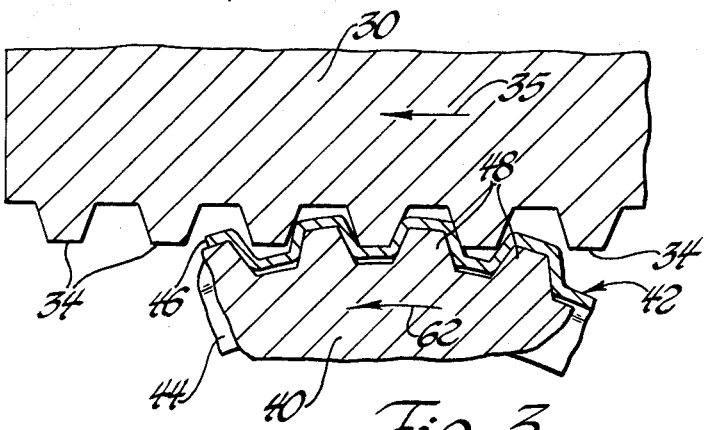
FIG. 3 is a sectional view taken along line 3—3 of FIG. 2.

When the mandrel 40 is supported by both of the arbors 54 and 56, the lower and upper dies 26 and 30 are respectively positioned generally adjacent the upper and lower sides of the mandrel as shown by FIG. 2. The machine 10 is actuated to drive the dies 26 and 30 into their overlapping relationship so that the die teeth 34 engage the outer surfaces on the annular sleeve portion 46 of the clutch hub blanks 42. As the dies 26 and 30 move into their overlapping relationship, the portions of the die teeth 34 at opposite lateral sides of the dies and the adjacent portions of the mandrel teeth 48 are meshed with the sleeve portion 46 of the hub blank located therebetween as shown in FIG. 3. The meshing of the die and the mandrel teeth deforms the sleeve portion 46 radially with respect to the central mandrel axis A—A and concomitantly therewith rotates the mandrel about this axis in the direction shown by the arcuate arrow 62 in FIG. 3 so the splining continues in a rolling manner to completion about the full circumference of the hub blanks 42. Both the upper and lower dies deform the hub blanks 42 to provide the splining in the manner shown by FIG. 3 at diametrically opposed positions on the mandrel 40.

Figure 6:
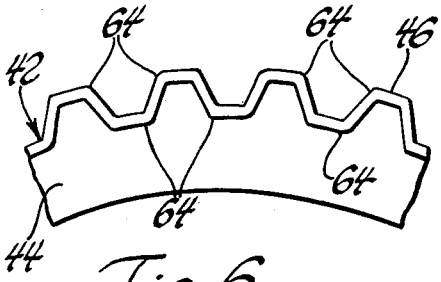
FIG. 6 is a fragmentary end view of a splined clutch hub made from the blank of FIG. 4, as viewed in the direction of FIG. 3.

After the dies 26 and 30 have been moved into their overlapping relationship to complete the splining operation, the sleeve portions 46 of the clutch hubs 42 define radially inwardly and outwardly facing splines 64 as seen in FIG. 6. The splines 64 permit clutch discs to be rotatably fixed to the clutch hubs either within or about the hubs and to be slidable along the central axis of the hubs. After the splining, the mandrel and splined clutch hubs are removed from the machine as an assembly by moving the tailstock 24 away from the headstock 20. Part of the deformation of the clutch hubs during the splining operation is an elastic deformation as opposed to a plastic deformation, the magnitude of which depends on the properties of the material of the hubs. Consequently, the splined sleeve portions 46 of the hubs will tend to spring back or move slightly away from the mandrel after the splining operation and can thus be removed from the mandrel with minimal effort. After removal of the splined clutch hubs from the mandrel, the mandrel receives another pair of clutch hub blanks to be splined during a subsequent operation of the machine.

Figure 9:
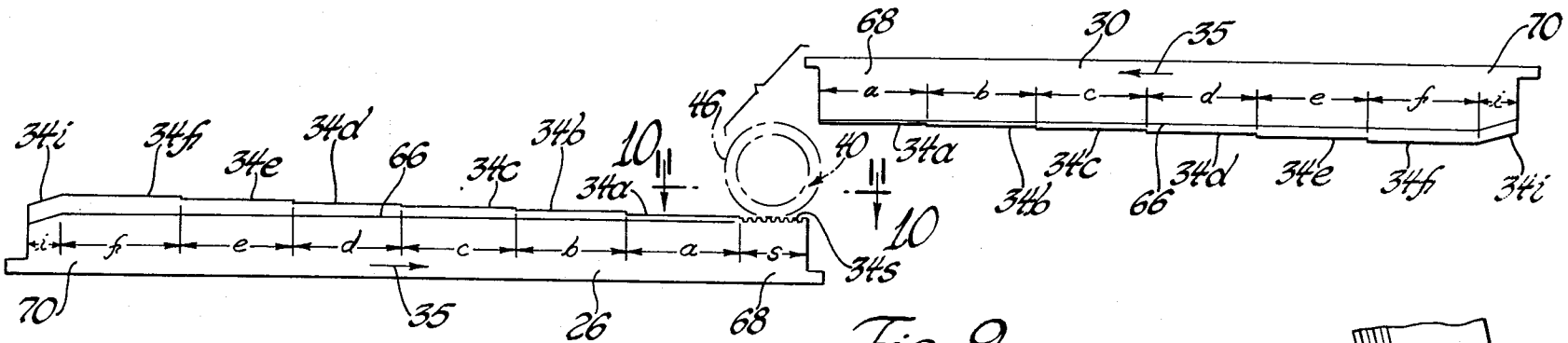
FIG. 9 is a view taken along line 9—9 of FIG. 2 and shows the upper and lower dies of the machine.
Figure 13:
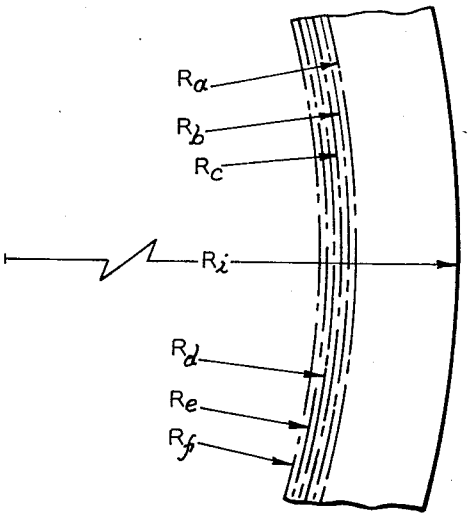
FIG. 13 is a schematic view illustrating the radial deformation during the spline rolling.

With reference to FIG. 9, the lower and upper dies 26 and 30 are conventionally referred to as gear racks and each includes groups of teeth *a*, *b*, *c*, *d*, *e* and *f* spaced along its length. The teeth of each gear rack 26 and 30 are shown schematically and indicated by reference numerals 34*a*, 34 b, 34*c*, 34*d*, 34*e* and 34*f*. The teeth 34 project from a common root line 66 and have progressively increasing heights from one group to the next moving in a direction from the leading ends 68 of the racks toward their trailing ends 70. The teeth of each group have the same tooth form or profile and have a combined length along their associated rack equal to at least one-half the circumference of the sleeve portion 46 of the hub blank to be splined. Consequently, the gear racks 26 and 30 form the splines in a progressive manner as the racks are moved from their end-to-end relationship shown in FIG. 9 into their overlapping relationship along the direction of arrows 35. The largest teeth 34*f* of the gear racks thus define the final conjugate tooth form splined during the final portion of the gear rack movement. The progressive radial splining is indicated schematically in FIG. 13 where the radii Ra, Rb, Rc, Rd, Re and Rf show the amount of deformation caused by the different groups of teeth *a*, *b*, *c*, *d*, *e* and *f* relative to the initial radius Ri.

Figure 11:
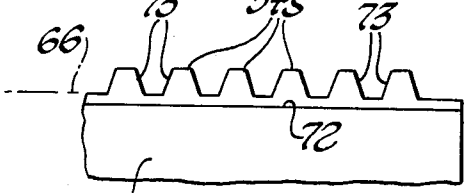
FIG. 11 is a side elevation view taken along line 11—11 of FIG. 10.
Figure 10:
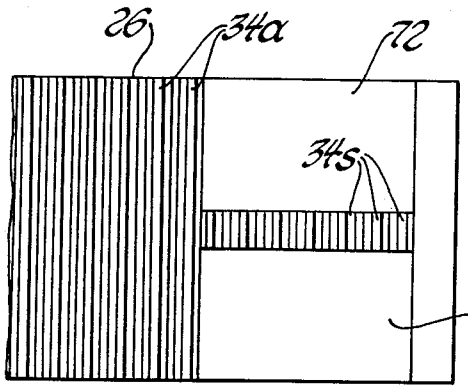
FIG. 10 is a fragmentary view of the lower die taken along line 10—10 of FIG. 9.

The lower gear rack 26 includes a plurality of synchronizing teeth 34s at its leading end 68 preceding the first group of teeth 34a that causes deformation during the splining. The synchronizing teeth are located intermediate the opposite lateral sides of lower rack 26, FIG. 10, between relieved flats 72 and are laterally aligned with the synchronizing member 52, FIG. 7, of the mounted mandrel 40. When the mandrel 40 is positioned in its FIG. 9 position, the synchronizing teeth 34s on lower rack 26 are meshed with the synchronizing teeth 53 of the mandrel synchronizing member 52 so as to cause the commencement of mandrel rotation concomitantly with the commencement of movement of racks 26 and 30 from their end-to-end relationship toward their overlapping relationship. The mandrel and clutch hub blanks or other power transmission members to be splined are thus rotating upon the initial deformation caused by the smallest group of teeth 34a on each rack. The synchronizing teeth 34s of rack 26 preferably have a tooth form, FIG. 11, that is substantially congruent to the tooth form of the largest group of teeth 34f, but have their sides 73 slightly relieved. Also, the synchronizing teeth 34s project from the root line 66 in the same manner as the other teeth 34. The synchronizing member 52 of the mandrel preferably has a splined configuration congruent with the splined configuration of the sleeve portion 46 after the splining is completed. In fact, the synchronizing member 52 may be formed from the sleeve portion of a clutch hub that has previously been splined by the machine. The configuration of synchronizing member 52 permits it to be slid onto the mandrel 40 intermediate the opposite ends 51 of the mandrel, as shown by FIG. 7, where it is secured in position in any suitable manner such as spot welding or resin bonding. The synchronizing teeth 53 of synchronizing member 52 are thus fully conjugate to the largest group of die teeth 34*f* which are themselves the same size as the synchronizing die teeth 34*s*, except for the relieved sides of the latter. Therefore, proper meshing of the synchronizing member 52 and the gear rack synchronizing teeth is ensured during the initial movement of the gear racks 26 and 30 toward their overlapping relationship.

The trailing ends 70 of the gear racks 26 and 30 include inclined poritons i having sets of inclined teeth 34*i*, FIG. 9. After the gear racks move completely through their overlapping relationship so that the largest group of teeth 34*f* on each rack have completed the splining operation, the racks move slightly farther so that the splined clutch hubs and mandrel are located between the sets of inclined teeth 34*i*. These teeth are positioned close enough to each other to remain slightly interengaged with the splined clutch hubs but are spaced far enough from each other to permit removal of the splined members and the mandrel on which they are supported. The racks are then moved back to their end-to-end relationship shown by FIG. 9 in preparation for another splining operation.

Figure 12:
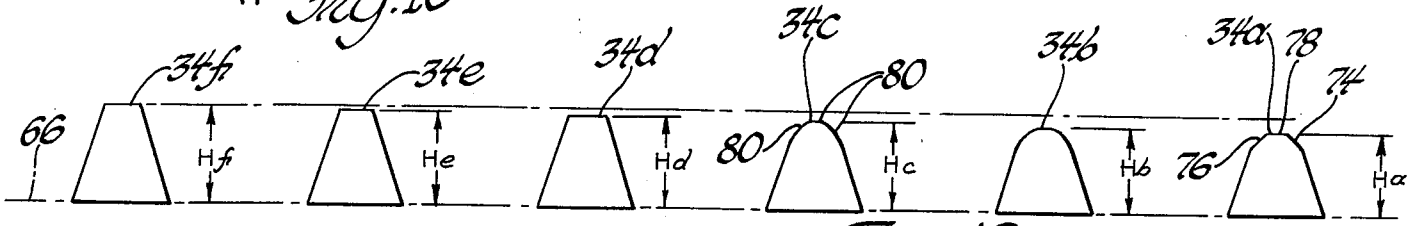
FIG. 12 is an enlarged view illustrating the various forms of the groups of teeth of the dies.

The tooth forms of the rack teeth 34 are shown in FIG. 12 as projecting from the root line 66 with heights Ha, Hb, Hc, Hd, He and Hf of progressively increasing size. Except for modifications to the smallest three groups of teeth 34*a*, 34*b* and 34*c*, the tooth forms are congruent between their tips and the root line 66 with the full conjugate tooth form 34*f* from its tip toward the root line 66 for a corresponding distance. The tooth form of teeth 34*d* from its tip to the root line for its height Hd is thus congruent to the tooth form of the largest group of teeth 34*f* from the tip of the latter toward the root line 66 for a distance equal to Hd. The gear racks are thus not formed by merely grinding off the tips of equal size teeth along a gear rack. Rather, the tips of each group of teeth, except for modifications that will be hereinafter described, are congruent to the tips of the largest group of teeth 34*f* for their corresponding heights. Such a type of tooth formation is described in U.S. Pat. No. 3,672,203, issued June 27, 1972.

The tooth tip form of the smallest group of teeth 34*a* includes straight line chamfers 74 and 76 at its leading and trailing sides, respectively, as seen in FIG. 12. Between the chamfers 74 and 76, this particular tooth form defines a flat tip surface 78 which causes the maximum radial deformation as the teeth 34*a* begin the splining operation. The flat tip surface 78 and the chamfers 74 and 76 cooperatively provide a tooth form which is capable of deforming the power transmission members such as the hub blanks being splined with a minimum of slippage due to the sharp junctures between the chamfers and the flat tip surface of the tooth form. The height Ha of teeth 34*a* is at least 75% of the height Hf of the largest group of teeth 34*f*. Consequently, the first group of teeth causes most of the radial deformation during the splining operation, see the schematic illustration of this in FIG. 13. It has been found that this stricture is important in maintaining the hub blank configuration roundness during the splining. It has also been found that it is preferable for the height Ha of the smallest group of teeth to be over 90% of the height Hf of the largest group of teeth in order to maintain the roundness of the clutch hub blanks during their splining operation.

The second group of teeth 34*b* to engage the hub blanks during the splining operation has a height Hb, FIG. 12, that is slightly larger than the height Ha of the first group of teeth 34*a*. The teeth 34*b* are formed by first grinding chamfers like those of teeth 34*a* and then grinding a rounded configuration onto the tooth tip so as to leave virtually no flat areas. This rounded tooth tip configuration of teeth 34*b* tends to eliminate the deformation markings that are caused by the chamfered configuration of the smallest group of teeth 34*a*. However, it should be remembered that this chamfered configuration of the smallest group of teeth or a similar gripping tooth configuration, is necessary in order to prevent slippage during the initial portion of the spline forming operation. After the initial stage of deformation by teeth 34*a*, the second group of teeth 34*b* begin to form the final spline configuration while radially deforming the hub blanks a slight amount. This slight amount of radial deformation helps in achieving the progressive forming of the splines toward their final configuration while maintaining the required roundness.

As seen in FIG. 12, the third group of teeth 34*c* to engage the hub blanks being splined have a tooth form whose tip is first chamfered like teeth 34*a* and then ground to have a rounded configuration similar to the second group of teeth 34*b*. The radius of curvature of the rounded tooth tip configuration of teeth 34*c* is slightly smaller than that of the second group of teeth 34*b* so as to leave small flats 80. The tooth tip configuration of teeth 34*c* is thus more like the tip configuration of the last group of teeth 34*f* than is the tip configuration of teeth 34*b*. Consequently, teeth 34*c* deform the splines toward their final configuration as the slightly increased height Hc of these teeth radially deform the splines a slight amount.

The tips of the two groups of teeth 34*d* and 34*e* are fully congruent to the tips of the largest group of teeth 34*f*. The only difference between these three groups of teeth is their respective heights from the root line 66 and the consequent amount of radial deformation caused as they engage the hub blanks being splined.

If the total radial deformation Hf caused by the largest group of teeth 34*f* is equal to 0.120 inch, the radial deformation Ha caused by the smallest group of teeth 34*a* is preferably 0.110 inch. Each succeeding group of teeth 34*b* through 34*f* after the first group has a height 0.002 inch larger than the preceding group so as to cause a slight amount of radial deformation with each group of teeth. This radial deformation in a progressive manner, but only for a slight amount after the large initial deformation, has been found useful in maintaining the roundness of the hub blanks being splined while still forming the splines to their full extent in the desired configuration.

The dies or gear racks 26 and 30 described above form the splines over their total lengths during each stage of the forming operation. The smaller teeth thus form the total length of each spline for their respective depths of penetration.

Figures 14, 15, 16, 17, 18, 19:
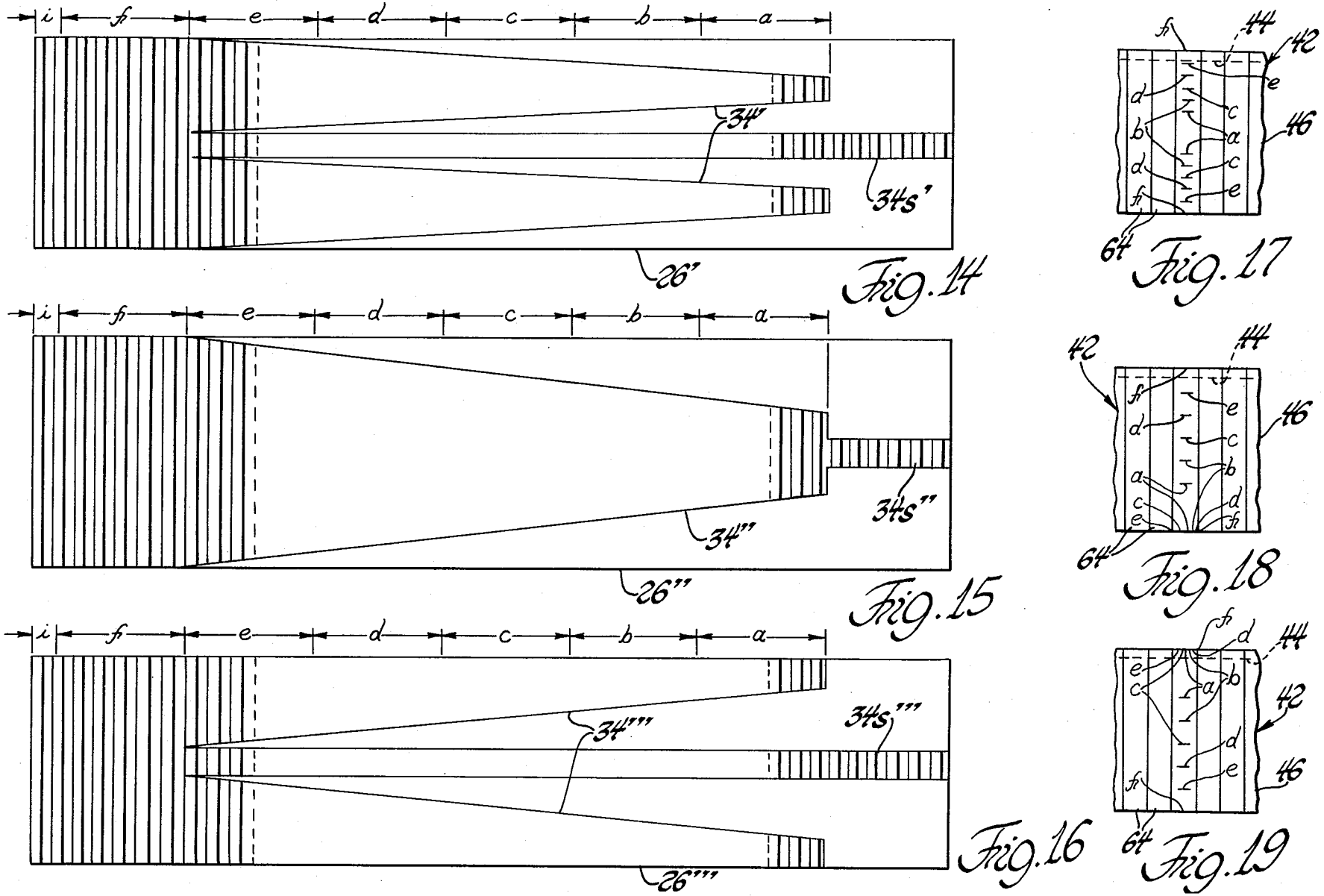
FIGS. 14, 15 and 16 are plan views of alternate embodiments of the dies for forming the splines lenghtwise in a progressive manner.
FIGS. 17, 18 and 19 are respectively associated with FIGS. 14, 15 and 16 and show fragmentary portions of members that are progressively splined lengthwise by their associated dies in a manner which is illustrated schematically.

FIGS. 14, 15 and 16 respectively illustrate alternate embodiments of the lower gear racks that are designated as 26', 26'', and 26'''. These gear racks are utilized with corresponding upper gear racks in the same manner previously described in connection with the gear racks 26 and 30. Each of these gear rack embodiments includes spline forming teeth 34', 34'', or 34''' that are arranged in groups *a*, *b*, *c*, *d*, *e* and *f* and have the tooth forms previously described. Likewise, these gear racks include the synchronizing teeth 34*s'*, 34*s''*, and 34*s'''* for synchronizing the commencement of mandrel rotation with the commencement of gear rack movement during the initial portion of the spline forming operation. However, the spline forming teeth are arranged to form the lengths of each spline progressively in addition to the progressive radial deformation.

With reference to FIG. 14, and to FIG. 17 that schematically illustrates the manner in which gear rack 26' splines a power transmission member such as clutch hub 42, the spline forming teeth 34' of this gear rack have shorter lengths adjacent the leading end of the rack than adjacent its trailing end. The synchronizing teeth 34*s'* extend along a central portion of the rack intermediate the spline forming teeth on opposite lateral sides of the rack. The spline forming teeth of group a are arranged to form the splines at a central portion of the annular sleeve portion 46 and do not form the splines along their total length. The teeth of group *b* form the splines for a correspondingly increasing length in a progressive manner as do those of groups *c*, *d* and *e*. The teeth of group *f* form the splines for their total length with the maximum radial deformation. Thus, in addition to the progressive radial deformation caused by the increasing sizes of the teeth groups, there is also a lengthwise progressive formation of the splines. This lengthwise progressive forming of the splines decreases the tooth load on the initial teeth of group a which cause most of the radial deformation, and thereby increases the tool life. The teeth of the following groups *b*, *c*, *d* and *e* cause considerable material movement in addition to their progressive radial forming at the central portions of the sleeve portions 46 being splined. FIG. 17 illustrates the approximate length of splining caused by each group of teeth along the length of the rack. It should be noted that the size of the splined hub 42 in FIG. 17 is enlarged for clarity, and that gear rack 26' forms splines on each of its sides in a pair of the hubs in the same manner previously described. Within each group, the teeth also have a progressively increasing length between its leading and trailing end so that there is also a progressive forming of the length of the splines between one end of each teeth group and the other. Consequently, it is not necessary to have a surge of power as the splining proceeds from one teeth group to the next. likewise, the progressive lengthwise splining evens out the power requirements necessary during the splining movement of the gear racks.

The gear rack 26'' shown in FIG. 15 also incorporates the progressive lengthwise splining described in connection with FIGS. 14 and 17. However, the lengthwise splining of the gear rack 26'', as best understood by reference also to the enlarged FIG. 18 of the splined hub, begins at teeth group a adjacent the open end of the hub and proceeds toward its closed end having the end wall 44. The teeth group a thus forms the splines 64 only adjacent the open end while the teeth group b proceeds with the deformation in a progressively increasing fashion toward the end wall 44. By the time the gear rack movement has been completed, the largest group of teeth *f* have fully formed the splines 64 for their total length and full radial extent on a pair of the hubs or other power transmission members being splined.

The gear rack 26''' shown in FIG. 16 is similar to the one shown in FIG. 15 but, as seen in connection with the enlarged FIG. 19, provides splining in a progressive lengthwise manner that begins adjacent the end wall 44 and proceeds in a progressive lengthwise manner toward the open end of the axial sleeve portion 46. Thus, teeth group a forms the spline adjacent the end wall 44 while the following groups form the splines in a progressive manner toward the other end of the sleeve portion 46 for increasing lengths. Two clutch hubs or other power transmission members are simultaneously splined by this gear rack in the same manner as the other racks previously described.

Figure 20:
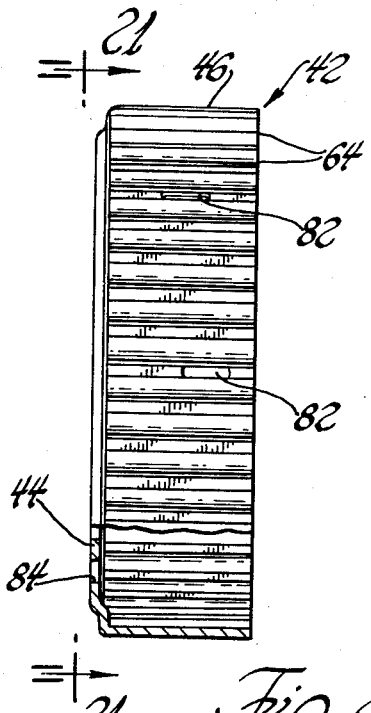
FIG. 20 is a broken away side view of a power transmission member embodying the invention.
Figure 21:
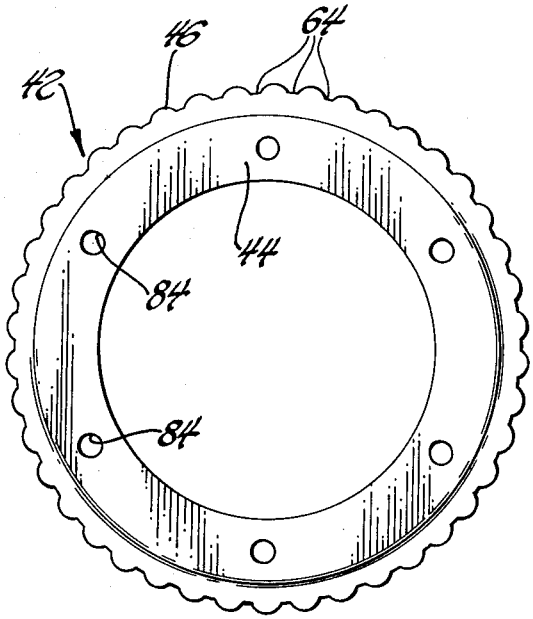
FIG. 21 is an end view of the power transmission member taken along line 21—21 of FIG. 20.

FIGS. 20 and 21 illustrate a power transmission member embodied as a splined clutch hub 42 that is splined by the rolling operation previously described. The splines 64 of this clutch hub are relatively tough due to a minimum of work hardening during the splining. The sleeve portion 46 of the clutch hub includes lubrication ports 82 that may be formed prior to the splining operation so as to be located between the outwardly projecting splines. During the splining, the axial length of the sleeve portion 46 remains generally constant and the end wall 44 is maintained relatively flat. The flatness of the end wall 44 enables it to be securely mounted on a clutch component such as by rivets projecting through holes 84 in the end wall 44. This mounting by rivets or other attachment fasteners has not heretofore been possible because such end walls were never capable of being maintained sufficiently flat during the splining forming operations utilized in the past to provide a secure mounting.

Figure 22:
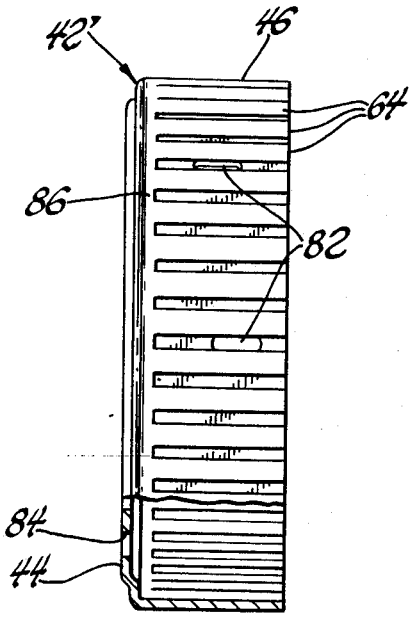
FIG. 22 is a view similar to FIG. 20 of another power transmission member.

The clutch hub 42' shown in FIG. 22 is similar to the one shown in FIGS. 20 and 21 but has its splines 64 terminated short of the end wall 44. Consequently, an annular ring 86 of the sleeve portion 46 is situated between the ends of the splines and the end wall 44 so as to help in maintaining the flatness of the end wall.

Figure 23:
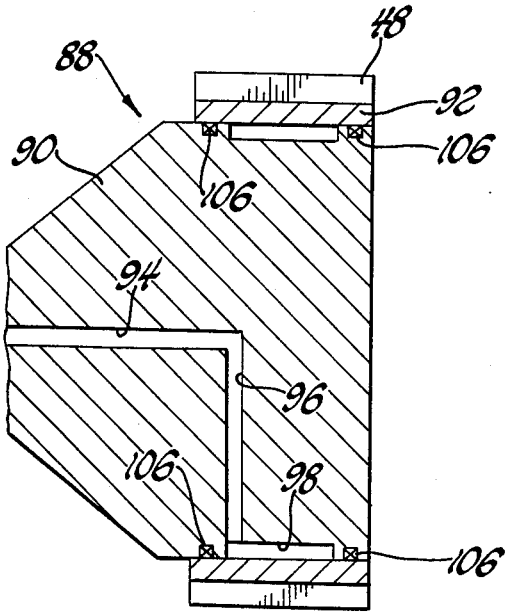
FIG. 23 is a sectional view of an expandable mandrel that may be utilized with the machine.

The clutch hub blanks 42 or other power transmission members to be splined may be mounted on an expandable mandrel like the one shown in FIG. 23 and indicated generally by reference numeral 88. Mandrel 88 includes an inner member 90 which is rotatably supported between the lower and upper gear racks of the spline rolling machine 10 in a suitable manner. An outer annular sleeve 92 of the mandrel is mounted on the inner member 90 and has radial projecting mandrel teeth 48 over which the sleeve portion 46 of the hub blank is positioned. An axial fluid passage 94 of the inner mandrel member 90 communicates with the inner end of a radial passage 96 whose outer end is communicated with an annular chamber 98. The annular chamber 98 is closed at its outer side by the sleeve 92 of the mandrel. Annular seals 106 at the axial ends of the annular chamber 98 prevent the escape of pressurized fluid supplied to it through the axial and radial passages. The pressurized fluid is supplied to the annular chamber to expand the sleeve 92 radially within its elastic limits in a manner that facilitates mounting of a hub blank to be splined onto the mandrel and removal of a clutch hub after the splining operation. This radial deformation does not have to be large, only one to several thousandths of an inch in extent will suffice, in order to facilitate the mounting and removal steps. Mandrels of this type are commercially available and no further description thereof is necessary.

While a specific form of the invention has been illustrated and described in the foregoing detailed description and accompanying drawings, it should be understood that the invention is not limited to the exact construction shown and that various alternatives in the construction and arrangement of parts will become apparent to those skilled in the art without departing from the scope and spirit of the invention.

What is claimed is:

1. A machine for forming splines in a thin-walled annular sleeve portion of a power transmission member having an annular end wall, the machine comprising the combination of:

a pair of elongated dies slidably mounted with respect to each other in a spaced and parallel relationship and movable between an end-to-end relationship and an overlapping relationship, each of said dies including teeth spaced along the length thereof:

an externally toothed pinion-type mandrel having an end for supporting the power transmission member by being received within the thin-walled sleeve portion thereof and engaged with the end wall thereof, the mandrel having a central axis about which the teeth thereof are generated; and means mounting the mandrel between the dies for rotational movement about the central axis of the mandrel, the mounting means including means for engaging the end wall of the member in an opposed relationship to the end of the mandrel so as to cooperate therewith in securing the member on the mandrel, sliding movement of the dies from their end-to-end relationship to their overlapping relationship engaging the dies with the annular sleeve portion of the member supported on the mandrel to mesh the die teeth and the mandrel teeth with the annular sleeve portion of the member therebetween, and the meshing of the die teeth and mandrel teeth deforming the sleeve portion of the member radially with respect to the central axis of the mandrel to form the splines in a rolling manner as the mandrel is rotated about its central axis on the mounting means.

2. A machine for forming splines in the thin-walled annular sleeve portions of power transmission members, the machine comprising the combination of:

a pair of elongated dies slidably mounted with respect to each other in a spaced and parallel relationship and movable between an end-to-end relationship and an overlapping relationship, each of said dies including teeth spaced along the length thereof;

an externally toothed pinion-type mandrel having a pair of ends for respectively supporting the thin-walled sleeve portions of a pair of power transmission members by being received therein, the mandrel having a central axis about which the teeth thereof are generated; and means removably mounting the mandrel between the dies for rotational movement about the central axis of the mandrel, sliding movement of the dies from their end-to-end relationship to their overlapping relationship engaging the dies with the annular sleeve portions of the members supported on the mandrel ends to mesh the die teeth and the mandrel teeth with the annular sleeve portions of the members therebetween, the meshing of the die teeth and mandrel teeth deforming the sleeve portions of the members radially with respect to the central axis of the mandrel to form the splines in a rolling manner as the mandrel is rotated about its central axis on the mounting means, and removal of the mandrel from the mounting means permitting the splined members to be removed from the mandrel ends so that another pair of members to be splined may be mounted on the mandrel ends.

3. A machine according to claim 2 wherein the mounting means includes a fixed headstock and a movable tailstock.

4. A machine according to claim 3 including a pair of coaxial arbors respectively mounted on the headstock and tailstock so as to rotatably support the mandrel.

5. A machine according to claim 4 wherein said pair of arbors includes a pair of coaxial shafts, and wherein the mandrel has an axial opening for receiving the arbor shafts so as to thereby support the mandrel for rotation.

6. A machine according to claim 1 wherein the die teeth extend transversely with respect to the elongated direction of the dies and parallel to the central axis of the mandrel so as to form splines on the power transmission member that are parallel to the axis about which the member is generated.

7. A machine for forming splines in a thin-walled annular sleeve portion fo a power transmission member, the machine comprising the combination of:

a pair of elongated dies slidably mounted with respect to each other in a spaced and parallel relationship and movable between an end-to-end relationship and an overlapping relationship, each of said dies including teeth spaced along the length thereof;

an externally toothed pinion-type mandrel that is expandable and retractable radially to facilitate mounting of an unsplined power transmission member thereon upon being received within the sleeve portion thereof and to facilitate removal of a splined member therefrom, the mandrel having a central axis about which the teeth thereof are generated; and means mounting the mandrel between the dies for rotational movement about the central axis of the mandrel, sliding movement of the dies from their end-to-end relationship to their overlapping relationship engaging the dies with the annular sleeve portion of the member supported on the mandrel to mesh the die teeth and the mandrel teeth with the annular sleeve portion of the member therebetween, and the meshing of the die teeth and mandrel teeth deforming the sleeve portion of the member radially with respect to the central axis of the mandrel to form the splines in a rolling manner as the mandrel is rotated about its central axis on the mounting means.

8. A machine according to claim 1 wherein the die teeth are arranged in groups along the length of each die, the teeth of each group being of the same size and having a combined length equal to at least one-half the circumference of the annular sleeve portion of a power transmission member to be splined, and the teeth being progressively larger from one group to the next moving in a direction opposite to the direction of die movement as the dies move to the overlapping relationship from the end-to-end relationship.

9. A machine according to claim 1 wherein one of the dies includes a plurality of synchronizing teeth that engage synchronizing teeth on the mandrel so mandrel rotation commences at the same time as the commencement of die movement from the end-to-end relationship to the overlapping relationship prior to any deformation of a power transmission member mounted on the mandrel.

10. A machine for forming splines in the thin-walled annular sleeve portions of power transmission members, the machine comprising:

a pair of rectilinearly elongated dies slidably mounted with respect to each other in a spaced and parallel relationship and movable between an end-to-end relationship and an overlapping relationship, each die including teeth spaced along the length thereof and extending transversely with respect to the direction of die movement in an opposed and parallel relationship with respect to the teeth of the other die, the teeth being arranged in groups along the dies which each have a length equal to at least one-half the circumference of the sleeve portion of a power transmission member to be splined, and the teeth within each group being of the same size and the teeth being of progressively increasing size from one group to the next in a direction opposite to the direction of die movement as the dies move to their overlapping relationship from the end-to-end relationshhip;

an externally toothed pinion-type mandrel having a pair of ends for respectively supporting the thin-walled sleeve portions of a pair of unsplined power transmission members, the mandrel having a central axis about which the teeth thereof are generated and the teeth of the mandrel being elongated in a direction parallel to the central axis of the mandrel; and means mounting the mandrel between the dies for rotational movement about the central axis of the mandrel, the mounting means orienting the central mandrel axis parallel to the transverse direction in which the die teeth extend at a location midway between the opposed teeth on the dies, sliding movement of the dies from their end-to-end relationship to their overlapping relationship engaging the dies with the annular sleeve portions of the members supported on the mandrel to mesh the die teeth and the mandrel teeth with the sleeve portions of the members therebetween, the meshing being with the groups of smaller teeth first and then the groups of larger teeth to progressively deform the sleeve portions of the members radially with respect to the central axis of the mandrel to form splines in a rolling manner as the mandrel is rotated about its central axis on the mounting means, and removal of the mandrel from the mounting means permitting the splined members to be removed from the mandrel ends so that another pair of members to be splined may be mounted on the mandrel ends.

11. A machine according to claim 10 wherein the smallest group of teeth on each die which first engages the sleeve portions of the members causes radial deformation equal to at least 75% of the total radial deformation caused by the dies in splining the members.

12. A machine according to claim 11 wherein the smallest group of teeth on each die causes radial deformation equal to over 90% of the total radial deformation.

13. A machine according to claim 11 wherein the tooth form of the group of smallest teeth has a flat tip with straight line chamfers on opposite sides thereof to prevent slippage between the dies and the sleeve portion being splined.

14. A machine according to claim 13 wherein the second smallest group of teeth has a tooth form whose tip has a rounded configuration.

15. A machine according to claim 14 wherein the third smallest group of teeth also has a tooth form whose tip is rounded but with a configuration more like the tip form of the largest group of teeth than is the rounded tip configuration of the second smallest group.

16. A machine according to claim 10 wherein the teeth of each die project from a common root line.

17. A machine according to claim 10 wherein one of the dies has a plurality of synchronizing teeth adjacent the smallest group of teeth, the mandrel having synchronizing teeth intermediate the ends thereof, said synchronizing die teeth being engageable with the synchronizing mandrel teeth to synchronize the commencement of mandrel rotation with the commencement of die movement from the end-to-end relationship toward the overlapping relationship.

18. A machine according to claim 17 wherein the synchronizing die teeth have a tooth form generally congruent to the tooth form of the group of teeth with the largest size.

19. A machine according to claim 18 wherein the synchronizing teeth of the mandrel are defined by a generally annular synchronizing member that has a splined configuration like the sleeve portion of a power transmission member after splining, said synchronizing member being slid onto the mandrel and secured thereto for use and being positioned intermediate the opposite ends of the mandrel.

20. A machine according to claim 10 wherein the teeth of each group have lengths that form the total length of each spline.

21. A machine according to claim 10 wherein the smaller teeth have lengths that form only a portion of the length of each spline, the larger teeth having lengths that form increasing lengths of the splines, and the consequent progressive lengthwise forming of the splines increasing the life of the die teeth by reducing the tooth load on the smaller teeth.

22. A machine according to claim 21 wherein the leading teeth within some of the groups of teeth have shorter lengths than the trailing teeth thereof so that the splining proceeds in a progressive manner lengthwise within these groups of teeth.

23. A machine according to claim 21 wherein the teeth are arranged so splining begins at an axial central portion of the annular sleeve portion being splined and proceeds towards opposite axial ends thereof.

24. A machine according to claim 21 wherein the teeth are arranged so splining begins at one axial end of the annular sleeve portion being splined and proceeds toward the other axial end thereof.

25. A machine according to claim 10 which is adapted to spline a power transmission member having an annular end wall of a flat configuration that extends radially at one axial end of the annular sleeve portion of the member, and the flatness of the end wall being maintained during the splining.

26. A machine according to claim 25 whose die teeth are arranged to form splines that terminate in an axially spaced relationship with respect to the end wall of the member being splined so as to provide an annular ring that helps maintain the flatness of the end wall.

27. A method for forming splines in a thin-walled annular sleeve portion of a power transmission member having an annular end wall, the method comprising:

positioning the sleeve portion of a power transmission member on an externally toothed pinion-type mandrel with the end wall of the member engaged with an end of the mandrel;

rotatably supporting the mandrel and the member carried thereby between a pair of elongated dies that have teeth spaced along their lengths while engaging the end wall of the member in an opposed relationship to the end of the mandrel so as to secure the member in position on the mandrel; and slidably moving the dies in opposite directions on opposite sides of the mandrel to mesh the die teeth and the mandrel teeth with the sleeve portion of the member therebetween so as to deform the sleeve portion radially in a rolling manner that forms splines as the mandrel rotates.

28. A method according to claim 27 wherein the mandrel is rotated prior to the deformation of the sleeve portion by cooperable synchronizing teeth on the mandrel and one of the dies.

29. A method for forming splines in thin-walled annular sleeve portions of a pair of power transmission members, the method comprising:

positioning the sleeve portions of a pair of power transmission members on opposite ends of an externally tooth pinion-type mandrel;

rotatably supporting the mandrel and the members carried thereby between a pair of elongated dies that have teeth spaced along their lengths; and slidably moving the dies in opposite directions on opposite sides of the mandrel to mesh the die teeth and the mandrel teeth with the sleeve portions of the members therebetween so as to deform the sleeve portions radially in a rolling manner that forms splines as the mandrel rotates.

30. A method according to claim 29 wherein the mandrel receives the two members on opposite ends thereof.

31. A method according to claim 27 wherein the splines are formed radially in a progressive manner by groups of teeth spaced along the dies and having an increasing size from one group to the next in a direction opposite to the direction of die movement.

32. A method according to claim 31 wherein at least 75% of the radial deformation is caused by the first group of teeth on each die to engage the sleeve portion of the member being splined.

33. A method according to claim 31 wherein over 90% of the radial deformation is caused by the first group of teeth on each die to engage the sleeve portion of the member being splined.

34. A method according to claim 31 wherein the first group of teeth on each die to engage the sleeve portion of the member causes radial deformation with a tooth form having a flat tip with straight line chamfers on opposite sides thereof so as to prevent slippage between the dies and the sleeve portion.

35. A method according to claim 34 wherein the second group of teeth on each die to engage the sleeve portion of the member causes radial deformation with a tooth form whose tip has a rounded configuration.

36. A method according to claim 35 wherein the third group of teeth on each die to engage the sleeve portion of the member causes radial deformation with a tooth form whose tip also has a rounded configuration that is more like the tip configuration of the largest group of teeth than is the tip configuration of the second group of teeth.

37. A method according to claim 31 wherein teeth of each group form the total length of the splines.

38. A method according to claim 31 wherein the splines are formed in a progressive manner lengthwise.

39. A method according to claim 38 wherein the progressive lengthwise splining begins at a central portion of each spline and proceeds toward opposite ends thereof.

40. A method according to claim 38 wherein the progressive lengthwise splining begins at one end of each spline and proceeds toward the other end.

41. A method according to claim 27 wherein the splines terminate short of the end wall to provide an annular ring that helps in maintaining a flat condition of the end wall.

42. A method for forming splines in a thin-walled annular sleeve portion of a power transmission member, the method comprising:

forming lubrication ports in the sleeve portion prior to forming the splines;

positioning the sleeve portion of the power transmission member on an externally toothed pinion-type mandrel;

rotatably supporting the mandrel and the member carried thereby between a pair of elongated dies that have teeth spaced along their lengths; and slidably moving the dies in opposite directions on opposite sides of the mandrel to mesh the die teeth and the mandrel teeth with the sleeve portion of the member therebetween so as to deform its annular portion radially in a rolling manner that forms splines as the mandrel rotates.

43. A method according to claim 42 wherein lubrication ports are formed between outwardly projecting portions of the splines.

44. A die for forming splines in a thin-walled annular sleeve portion of a power transmission member, the die comprising: an elongated gear rack having leading and trailing ends and teeth spaced along its length so as to be adaptable to mesh with a rotatable toothed mandrel with the sleeve portion of the member therebetween in a manner that rotates the mandrel and splines the member as the meshing proceeds from the leading end toward the trailing end; the teeth projecting from a common root line and being arranged in groups which each have a length of at least one-half the circumference of the sleeve portion; the teeth within each group having the same tooth form and the same height projecting from the root line, and the heights of the groups of teeth increasing progressively from one group to the next moving from the leading end toward the trailing end so the splines are formed in a progressive manner; the leading group of teeth at the leading end of the rack having a height of at least 75% of the height of the trailing group of teeth at the trailing end of the rack so that most of the material movement during deformation is caused by the leading group; and the leading end of the gear rack incuding synchronizing teeth for engaging synchronizing teeth on the mandrel to synchronize the mandrel rotation with the die movement as well as including a relieved portion adjacent the die synchronizing teeth for receiving the sleeve portion of the member being splined.

45. A die according to claim 44 wherein two groups of teeth immediately trailing the leading group have tooth forms with tip configurations for forming the splines toward their final shape formed by the largest group of teeth at the trailing end of the rack.

46. A die according to claim 45 wherein the leading group of teeth has a tip with a chamfered form and the two groups of teeth following the leading one have tips with rounded forms.

47. A die according to claim 44 wherein the synchronizing teeth of the gear rack have a tooth form substantially congruent to the tooth form of the trailing group of teeth at the trailing end of the gear rack but with the sides of the synchronizing tooth form slightly relieved.

48. A die according to claim 44 wherein the synchronizing teeth of the gear rack are located intermediate lateral sides of the rack so that a pair of the power transmission members may be simultaneously splined by the rack by the opposite lateral sides thereof.

49. A power transmission member comprising: an end wall of an annular shape extending about a central axis of the member; the end wall extending radially with respect to the axis and having a flat shape so as to permit mounting of the member for use; an annular sleeve portion extending axially from the end wall; said sleeve portion being formed with splines by a rolling process incorporating a toothed mandrel received within the sleeve portion and a pair of elongated racks having teeth along their lengths; the splines formed in the sleeve portion being relatively tough due to the minimal amount of work hardening resulting from the rolling process; and the end wall maintaining its flatness during the rolling process so the splined member may be mounted for use.

50. A member according to claim 49 wherein the splines terminate in a spaced relationship to the end wall so the sleeve portion includes an unsplined ring that helps maintain the flatness of the end wall.

* * * * *